US009745024B2

(12) United States Patent
Sherwood

(10) Patent No.: US 9,745,024 B2
(45) Date of Patent: Aug. 29, 2017

(54) RECESSED BARGE DESIGN

(71) Applicant: Offshore Construction Services Pte Ltd, Singapore (SG)

(72) Inventor: Joe Marvin Sherwood, Singapore (SG)

(73) Assignee: OFFSHORE CONSTRUCTION SERVICES PTE LTD., Singapore (SG)

( * ) Notice: Subject to any disclaimer, the term of this patent is extended or adjusted under 35 U.S.C. 154(b) by 0 days.

(21) Appl. No.: 14/691,947

(22) Filed: Apr. 21, 2015

(65) Prior Publication Data

US 2015/0307164 A1 Oct. 29, 2015

Related U.S. Application Data

(60) Provisional application No. 61/984,595, filed on Apr. 25, 2014.

(51) Int. Cl.

| | |
|---|---|
| ***B63B 25/08*** | (2006.01) |
| ***B63B 25/02*** | (2006.01) |
| ***E21B 21/01*** | (2006.01) |
| *E02F 7/04* | (2006.01) |
| *E02F 7/06* | (2006.01) |

(52) U.S. Cl.

CPC ..... *B63B 25/02* (2013.01); *E21B 21/01* (2013.01); *B63B 2025/025* (2013.01); *E02F 7/04* (2013.01); *E02F 7/065* (2013.01)

(58) Field of Classification Search

CPC ..... B63B 25/02; E21B 21/01

See application file for complete search history.

(56) References Cited

U.S. PATENT DOCUMENTS

| | | | | |
|---|---|---|---|---|
| 3,513,797 | A * | 5/1970 | Frankel | B63B 11/04 114/125 |
| 3,740,307 | A * | 6/1973 | Rapson et al. | D21C 11/0078 162/17 |
| 4,136,009 | A * | 1/1979 | Samiran | B01D 17/0214 210/114 |
| 6,167,827 | B1 * | 1/2001 | Keehan | B63B 11/04 114/74 A |
| 6,796,379 | B1 * | 9/2004 | Martin | E21B 21/001 166/356 |
| 2005/0000400 | A1 * | 1/2005 | Kingsbury | B63B 1/121 114/61.1 |
| 2012/0280181 | A1 * | 11/2012 | Ruger | C10B 53/02 252/373 |
| 2013/0192510 | A1 * | 8/2013 | Jang | F17C 13/082 114/74 R |

* cited by examiner

*Primary Examiner* — Stephen Avila

(74) *Attorney, Agent, or Firm* — Muncy, Geissler, Olds & Lowe, P.C.

(57) ABSTRACT

An ocean-going single-hulled barge with an isolated sunken or recessed area that supports storage vessels and mixing equipment capable of processing, storing and transporting hazardous materials. The recessed area includes dedicated drains which collect all associated hazardous spills and fluids for appropriate disposal and processing. The barge can also be adapted to hold a complete liquid mud plant within the recessed area.

11 Claims, 4 Drawing Sheets

RECESSED BARGE DESIGN

CROSS REFERENCE TO RELATED APPLICATIONS

This application claims priority of U.S. Provisional Application No. 61/984,595 filed on 25 Apr. 2014 under 35 U.S.C. 119(e), the entire contents of which is hereby incorporated by reference.

FIELD OF THE INVENTION

The present disclosure relates generally to an apparatus for providing storage of fluids, solids or liquids in an ocean-going barge. More particularly, the present disclosure relates to a barge having a main deck area which recesses the hazardous materials storage and handling into a 'sunken' area of the main deck and which also has a dedicated drains collection system.

BACKGROUND OF INVENTION

Offshore oil rigs are supported by work boats, supply boats, crew boats and helicopters. These logistical supply vehicles cost a lot to maintain. Using a barge as an intermediary storage/work platform can reduce the number of runs needed by these vehicles. One of the most prominent materials that requires daily logistical support is the drilling fluid associated with the oil or gas well being drilled by that rig.

Various fluids ("well fluids") may be used on the oil rig and may include both solids and liquids. Common uses for well fluids include: lubrication and cooling of drill bit cutting surfaces while drilling generally or drilling-in (i.e., drilling in a targeted petroleum bearing formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, placing a packer fluid, abandoning the well or preparing the well for abandonment, and otherwise treating the well or the formation.

Since environmental problems and logistics are difficult and space is a priority on an oil rig, the storage and handling of fluids must be done as efficiently as possible. These fluids include various components that may be recycled and re-used or may be treated prior to disposal. Between the various operations, these fluids may be temporarily stored in a tank system. For example, when a wellbore fluid brings cuttings to the surface, the mixture is typically subjected to various mechanical treatments (shakers, centrifuges, etc.) to separate the cuttings from the recyclable wellbore fluid. However, the cuttings may need to be treated or the recyclable wellbore fluid may need to be stored until it is used again. Oil rig pit systems are currently very limited and cannot process the mud mix.

Typically, storage vessels are provided on a lower level of the platform and gravity is used to provide the fluids to them. Environmental controls no longer allow washing out storage pits through the dump valves into the ocean. These residues left in an open pit mud mix carrier can be extremely difficult to displace resulting in huge vessel tank cleaning costs in port. All solvents and water used to clean the inside of the pit are also deemed hazardous and require processing as well.

These limitations and costs complicate the transportation of fluid back to land for additional processing and treatment. Furthermore, as disclosed below, this additional treatment can be mounted on a barge. This obviates the need for any transportation back to shore. Accordingly, there exists a need for a drill fluids tank system to be incorporated into a barge design or placed upon a barge which will moor alongside or in close proximity to an operational well.

Referring to FIG. 1, the drawing illustrates a conventional double-hulled barge design 1 which has a main deck that is flat. With a conventional design most fluids are stored within the barge hull 2 and cargo/equipment is mounted onto the main deck. Both fluid and cargo can be in transit or in operations while on the barge.

Conventional barge designs require a double hull when storing any hazardous fluid within its hold that is greater than 600 cubic meters in volume. This is in accordance with International Maritime Organization (IMO) regulations on transporting hazardous fluids. However, constructing a double hull over the entire ship to comply with these regulations is very expensive.

Referring to FIG. 2, the storage of drilling fluids within the barge's tanks 4 creates several issues for the end user which the novel recessed design avoids. Drilling fluids are heavy, thick and burdened with solids both drilled solids and mixed chemical solids. These solids settle out quickly if left unattended (not mixed or transferred). This hazardous fluid (drilling muds and/or base oils) can become most difficult to remove from a hold down deep in the barge. To remove this settled fluid from any barge pit/tank system within the tank 4 could require personnel to enter that confined space under the main deck 3 to work at removing the product.

SUMMARY OF INVENTION

In one aspect, embodiments disclosed herein relate to a conventional single-hulled ocean going barge design that incorporates a sunken or recessed area to which the drill fluids storage vessels (tanks or pits) are mounted along with all mud mix components.

In another aspect, embodiments disclosed herein relate to an ocean going barge with a supported and isolated sunken or recessed area that supports the storage vessels and mixing equipment as well as collects all associated hazardous spills and fluids for appropriate disposal and processing.

In another aspect, the disclosed embodiments provide user friendly access to tanks that store and handle the drill fluid while remaining accessible by the end user via sight, touch, wash hose, vacuum hose, etc. This obviates the need for personnel to enter a 'confined' space to clean or empty fluid storage tanks.

In another aspect, the disclosed embodiments utilize steel more efficiently by only providing redundant enclosure for the materials and liquids that are hazardous. This negates the need for a double-hulled structure. The novel structure also lowers the center of gravity on the barge by lowering the height of the drill fluid being stored in the pits/tanks.

In another aspect, embodiments disclosed herein relate to a system of tanks/pits, valves, pipes, chemical additive devices (hoppers, surge tanks, additive units) to be mounted within a recessed area on the main deck to provide processing for mud mix operations and provide the ability to capture and return any unplanned release or spill.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein.

DETAILED DESCRIPTION

In one aspect, embodiments disclosed herein relate to a vessel, and more specifically, to a conventional single-hulled ocean-going barge which is enabled to transport and process hazardous materials. In another aspect, the vessel is a barge configured to contain a full liquid mud plant for storing and recycling mud mix.

Figure 1:
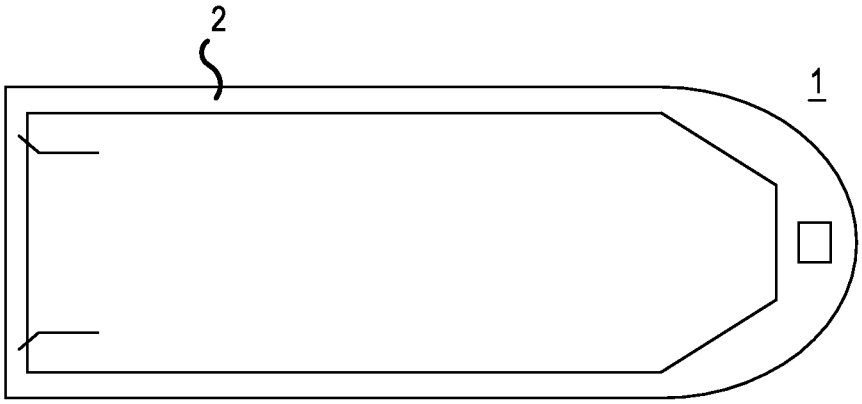
FIG.1 PRIOR ART
FIG. 1 is a top plan view of a conventional open double-hulled barge design with the deck removed.
Figure 2:
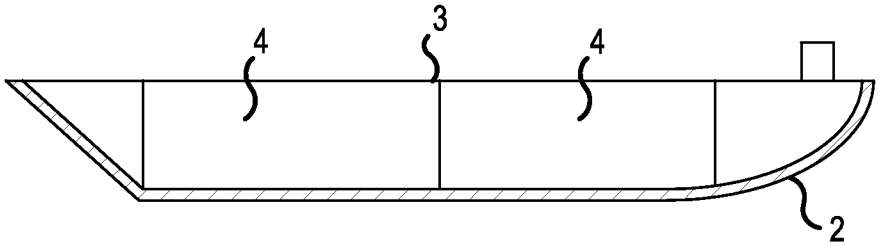
FIG.2 PRIOR ART
FIG. 2 is a side cross-section view of a conventional double-hulled barge design and tanks.
Figure 3:
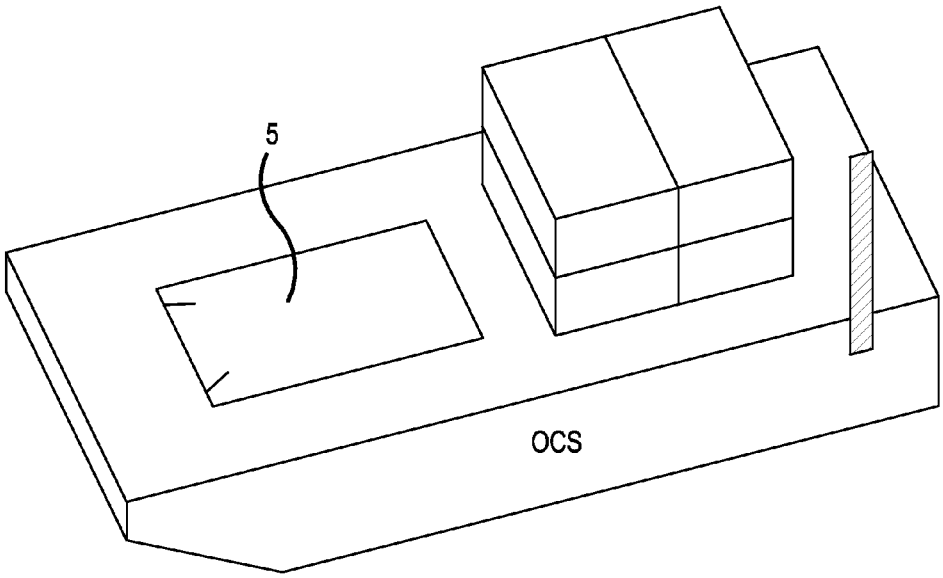
FIG. 3 is a perspective view of the novel recessed barge design disclosed herein.

Referring to FIG. 3, the physical location of the sunken or recessed area 5 is shown in respect to the barge. This area supports the storage vessels and mud mixing equipment as well as collects all associated hazardous spills and fluids for appropriate disposal and processing. The illustrated recessed area can be increased or decreased depending on storage and processing design requirements. Furthermore, its placement can be adjusted to any area on the deck and is not limited to the center of the barge. The inside of the recessed area can be outfitted with an automatic tank cleaner.

Figure 4:
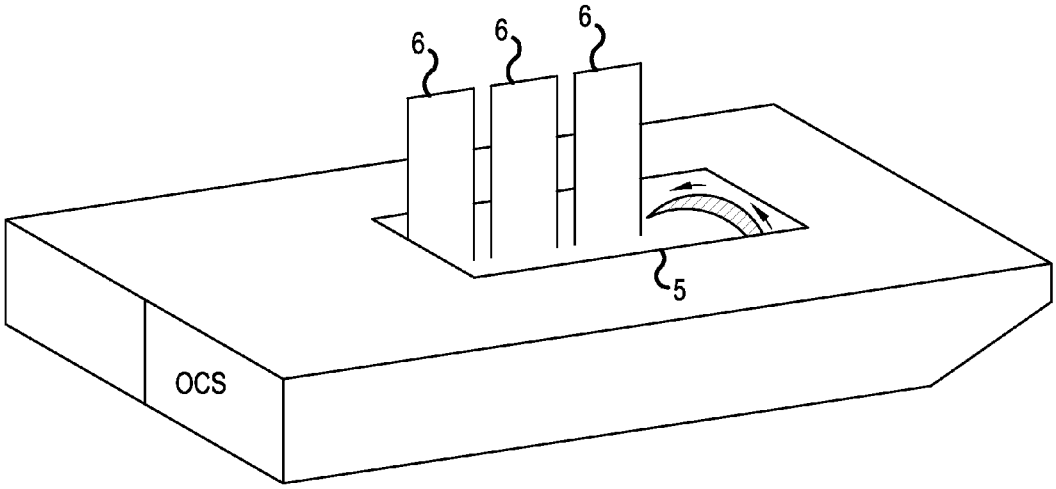
FIG. 4 is a perspective view of the novel recessed barge design disclosed herein with tanks in the recessed area.

Referring to FIG. 4, this recessed area isolates in excess of 100 percent of a tank/pits stored volume 6 of hazardous materials with welded, sealed walls and floor. According to a preferred embodiment, the recessed area can be up to 3.0 meters in depth from the top of the main deck, but any depth is feasible. As illustrated, the recessed area can be accessed by a ramp which would allow fork lifts and other heavy machinery to add or remove storage tanks as needed. According to a preferred embodiment, the recessed area is located midship to distribute weight (ballast) while in operational mode. Other positions could be preferred depending on ballast.

This recess area has its own hazardous drains collection and segregation system. This is due to IMO criteria that no other drain can be mixed with a hazardous drains flow. All drilling fluids, unplanned releases and spills are categorized as hazardous as they can contain petroleum-based fluids that could contaminate the environment. Current design specifications lean towards less than 5 ppm hydrocarbon in recovered fluids released from vessels. This 5 ppm is the low range target for the built-in hazardous drains process. The ultimate goal is 'zero' discharge and any reduction towards this number ensures a longer life for the vessel and increases the client base due to local variations in regulations.

This embodiment of the invention pertains to a barge with a recessed area to store tanks of mud mix for transportation to on-shore processing. Keeping the mud in tanks 6 eliminates cleaning costs and facilitates transfer to the shore for processing. The same tanks can also be received on shore after the separation and recycling process for transport back to the oil rig.

Thus, in this embodiment the barge would only transport mud mix but do so in an easily transferable way and while maintaining environmental standards. The recessed area combined with the dedicated drain and separator provides redundant protection for any number of hazardous materials or liquids that may be stored therein.

Figure 5:
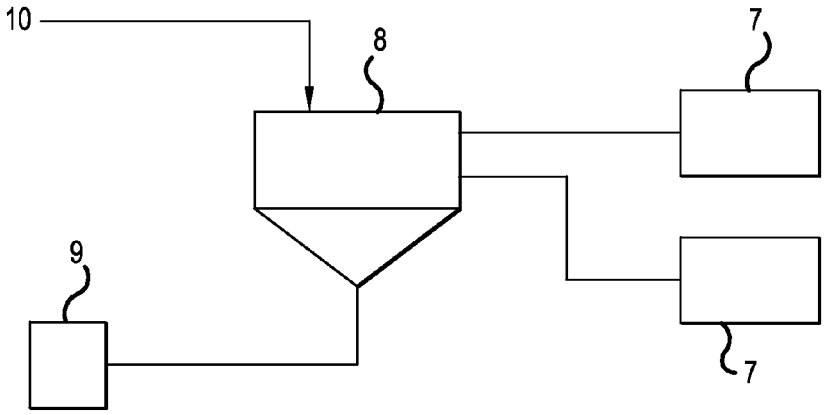
FIG. 5 is the schematic of the dedicated drains collection and segregation system disclosed herein.

Referring to FIG. 5, the disclosed schematic is of a basic hazardous drain flow collection well with a primary segregator. The hazardous drains are first collected in a buffer tank 9 which is a part of the vessel. From this tank the hazardous drains fluid is picked up by a positive displacement-type pump and fed into the segregator 8. Multiple collection points fed in though input 10 and various filtering devices 7 can alternatively be used. The illustrated collector segregates the dense phase and returns it to the mud mix plant via a pump or vacuum.

Figure 6:
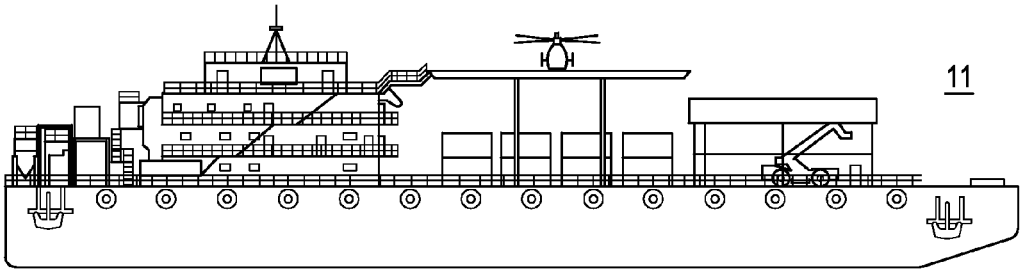
FIG. 6 is a side view of the barge vessel assembly in accordance with embodiments disclosed herein.

Referring to FIG. 6, the illustrated drawing is a side view of the disclosed barge 11 according to a preferred embodiment. This barge can include a pilot house 12, helicopter pad 13 and a full liquid mud plant (LMP) 14 which is contained within the recessed area. Other necessary equipment such as propulsion, control surfaces, navigation, and stabilization systems can also be provided on board.

Figure 7:
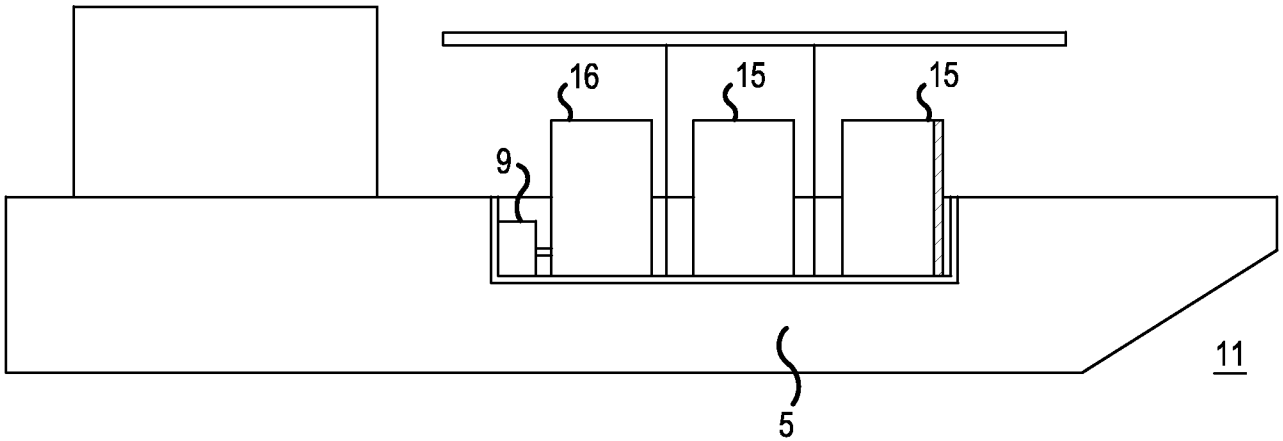
FIG. 7 is a side cross-section view showing the recessed area with the LMP in place as disclosed herein.

Referring to FIG. 7, the illustrated cutaway side view shows the LMP tanks 15 mounted in the recessed containment area 5 with a collection and separation system which was further described in FIG. 5. Additionally, the recessed area contains mixing equipment 16 for processing, maintaining and manufacturing the mud mix. This arrangement allows the LMP barge to supply the oil rig with mud mix without shuttling back and forth from the shore. It also advantageously provides recycling and separation services for used mud mix right at the drill site.

The waste fluids include various components that may be recycled and re-used or may be treated prior to disposal. Between the various operations, these fluids may be temporarily stored in a tank system. For example, when wellbore fluid brings cuttings to the surface, the mixture is typically subjected to various mechanical treatments (shakers, centrifuges, etc.) to separate the cuttings from the recyclable wellbore fluid. Typically any advanced or additional process would be done on shore requiring constant transportation between the rig and the shore. Furthermore, the cuttings may need to be treated or the recyclable wellbore fluid may need to be stored until it is used again. The novel LMP barge disclosed herein can handle all these process while anchored near the oil rig.

Any unplanned spills from this plant are caught and contained within the recessed area and drained through a segregated drain system to the collection and separation system for recycling and return to the tanks. As a result, the recessed barge design is not limited to mud mixing operations as it can also handle hazardous material transportation, petroleum preprocessing, and any other process requiring hazardous material containment.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure that are known or customary practice in the art to which this invention pertains.

What is claimed:

1. An ocean-going single-hulled vessel, comprising:

a hull covered by a main deck, a recessed area of the main deck with sealed walls and bottom to isolate hazardous materials within the recessed area, a dedicated drain system for the recessed area, and a dense phase return to active pneumatic system for separating and returning the fluid, collected by the dedicated drain system to storage tanks disposed within the recessed area, wherein the dedicated drain system collects all fluid draining out of the entire recessed area.

2. The vessel of claim 1, further comprising a tank system with agitation disposed within the recessed area.

3. The vessel of claim 1, further comprising an automatic tank cleaner.

4. The vessel of claim 1, wherein the dedicated drain system includes a segregator, wherein the fluid collected by the dedicated drain system is fed into a segregator.

5. The vessel of claim 1, further comprising an access ramp extending down into the recess area.

6. The vessel of claim 1, further comprising a piping and pump system mounted within the recessed area.

7. The vessel of claim 1, further comprising a helicopter pad and pilot house.

8. The vessel of claim 1, further comprising a mud mix processing plant located within the recess area.

9. The vessel of claim 8, wherein the mud mix plant includes mechanical separators, chemical treatment and mixing equipment, and storage tanks.

10. The vessel of claim 8, wherein the mud mix plant is configured to recycle and/or manufacture well-bore fluid.

11. The vessel of claim 1, wherein a floor of the recessed area is separated by a open gap from the hull of the vessel.

* * * * *